US009599363B1

(12) United States Patent
Smith et al.

(10) Patent No.: US 9,599,363 B1
(45) Date of Patent: Mar. 21, 2017

(54) AIR CURTAIN FOR AN AIR HANDLER

(71) Applicant: NexRev Inc., Plano, TX (US)

(72) Inventors: Kenneth R. Smith, Plano, TX (US); David E Dellinger, Louisburg, KS (US)

(73) Assignee: NexRev Inc., Plano, TX (US)

( * ) Notice: Subject to any disclaimer, the term of this patent is extended or adjusted under 35 U.S.C. 154(b) by 324 days.

(21) Appl. No.: 14/519,044

(22) Filed: Oct. 20, 2014

(51) Int. Cl.
*F24F 13/10* (2006.01)

(52) U.S. Cl.
CPC ..... *F24F 13/10* (2013.01)

(58) Field of Classification Search
CPC ... F01P 7/02; F01P 7/10; F25D 23/021; F25D 23/023
USPC ..... 165/96, 98, 99
See application file for complete search history.

(56) References Cited

U.S. PATENT DOCUMENTS 1,472,650 A * 10/1923 Hoffman ..... F01P 7/10 160/239
1,608,161 A * 11/1926 Blair ..... B60K 11/04 165/98
1,665,695 A * 4/1928 Garnsey ..... F01P 7/10 165/98
4,288,992 A * 9/1981 Eliason ..... E06B 3/80 160/332
4,450,899 A * 5/1984 Jakobsson ..... F28B 1/06 165/108
5,159,974 A * 11/1992 Victory, Jr. ..... F28B 1/06 165/96

FOREIGN PATENT DOCUMENTS

DE FR 2559432 A1 * 8/1985 ..... B60K 11/04

* cited by examiner

*Primary Examiner* — Tho V Duong
(74) *Attorney, Agent, or Firm* — Mark W Handley

(57) ABSTRACT

An air curtain (18) for an air handler (12) is disclosed for moving to block air from passing through selected cooling coils (14). The cooling coils (14) are separated into separate sections (1-4) along a lineal direction (22), with the separate sections (1-4) connected to respective compressors (52), condensers (54), and expansion valves (56). The air curtain (18) is located on one side of the cooling coils (14) and furled into a housing (16) to provide full flow airflow through all the separate cooling coil sections (1-4). The air curtain (18) unfurls along the lineal direction (22) to block airflow (46) through selected sections (1-4) of the cooling coils (14). Position sensors (24-30) are mounted in registration with edge regions (32) of the cooling coil sections (1-4) and detect when a terminal end (20) of the air curtain (18) is proximate to respective ones of the positions sensors (24-30).

20 Claims, 2 Drawing Sheets

AIR CURTAIN FOR AN AIR HANDLER

TECHNICAL FIELD OF THE INVENTION

The present invention relates in general to air handlers for buildings, and in particular to air handlers each having a number of separate coils which are selectively operated according cooling loads applied to the air handlers.

BACKGROUND OF THE INVENTION

Air handlers for building air conditioning systems have a plurality of cooling coils connected to one or more compressors. The compressors move refrigerants through the cooling coils as air is drawn over the cooling coils to condition the air, usually cooling or heating the air. To promote efficiency some air handlers will have separate cooling coils with each of the cooling coils connected to a corresponding compressor, condenser, and expansion valve. Providing separate cooling coils allows the heating and cooling load of the air handler to be varied by selectively operating less than all of the cooling coils and corresponding compressors. However, during low load conditions air will continue to flow over the cooling coils not being operated while only the air flowing across the active coils is conditioned. Air passing through an air handler is often cooled to control the amount of moisture in conditioned air.

SUMMARY OF THE INVENTION

A novel air curtain for an air handler is disclosed for moving to block air from passing through selected cooling coils. The cooling coils are separated into separate sections along a lineal direction, with the separate sections connected to respective compressors, condensers, and expansion valves. The air curtain is secured on one side of the cooling coils and furled into a housing to provide full flow airflow through all the separate cooling coil sections. A drive motor unfurls the air curtain along the lineal direction to block airflow through selected sections of the cooling coils. Position sensors are mounted in registration with edge regions of the cooling coil sections and detect when a terminal end of the air curtain is proximate to respective ones of the positions sensors.

DESCRIPTION OF THE DRAWINGS

For a more complete understanding of the present invention and the advantages thereof, reference is now made to the following description taken in conjunction with the accompanying Drawings in which

FIG. 1 is a side, elevation view of an air handler with the closest side panel removed to show an air curtain; and FIG. 2 is vertical section view of the air handler taken along Section Line 2-2.

DETAILED DESCRIPTION OF THE INVENTION

Figure 1:
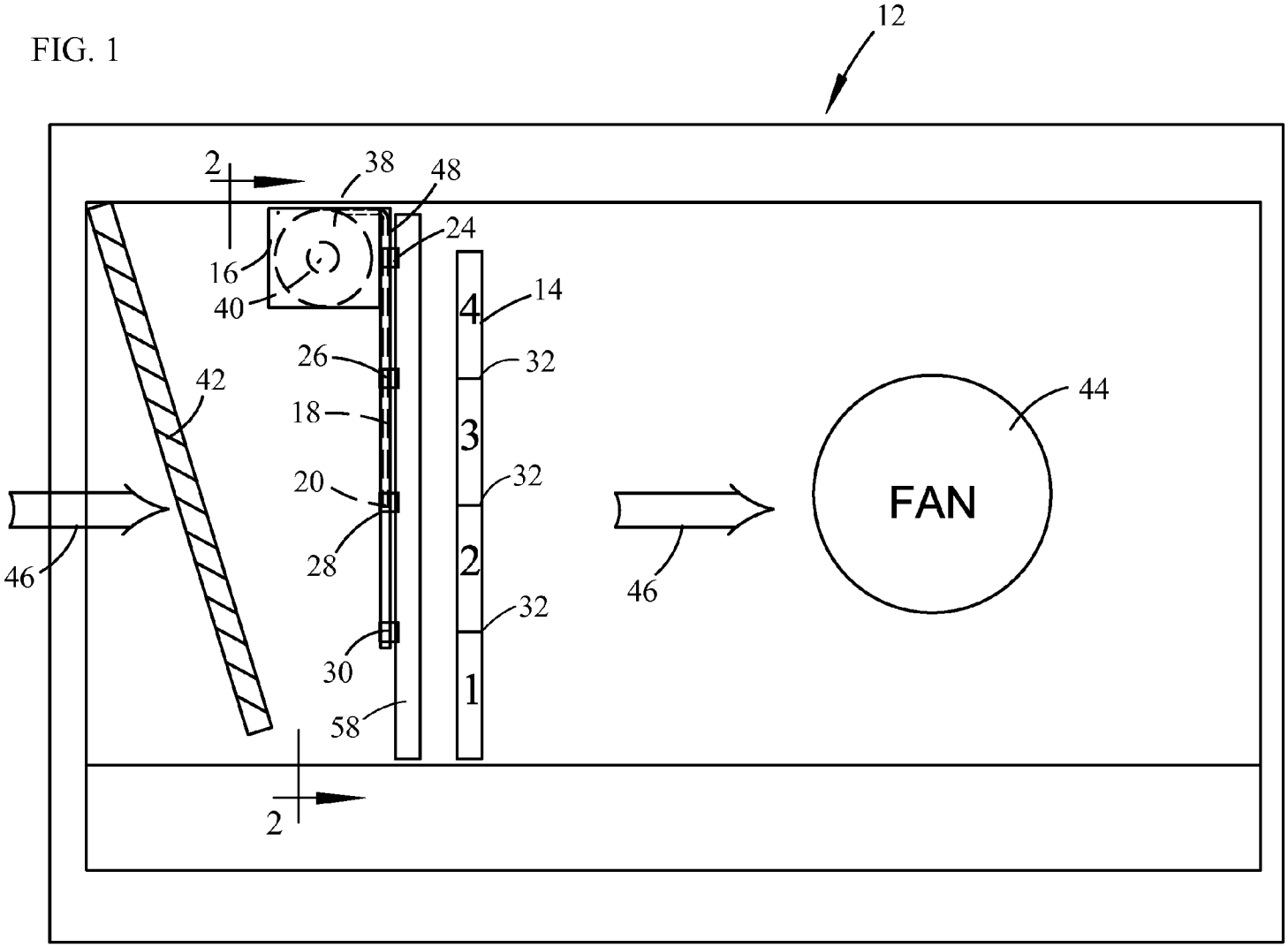
FIGS. 1 and 2 show various aspects for air curtain for an air handler made according to the present invention, as set forth below.
Figure 2:
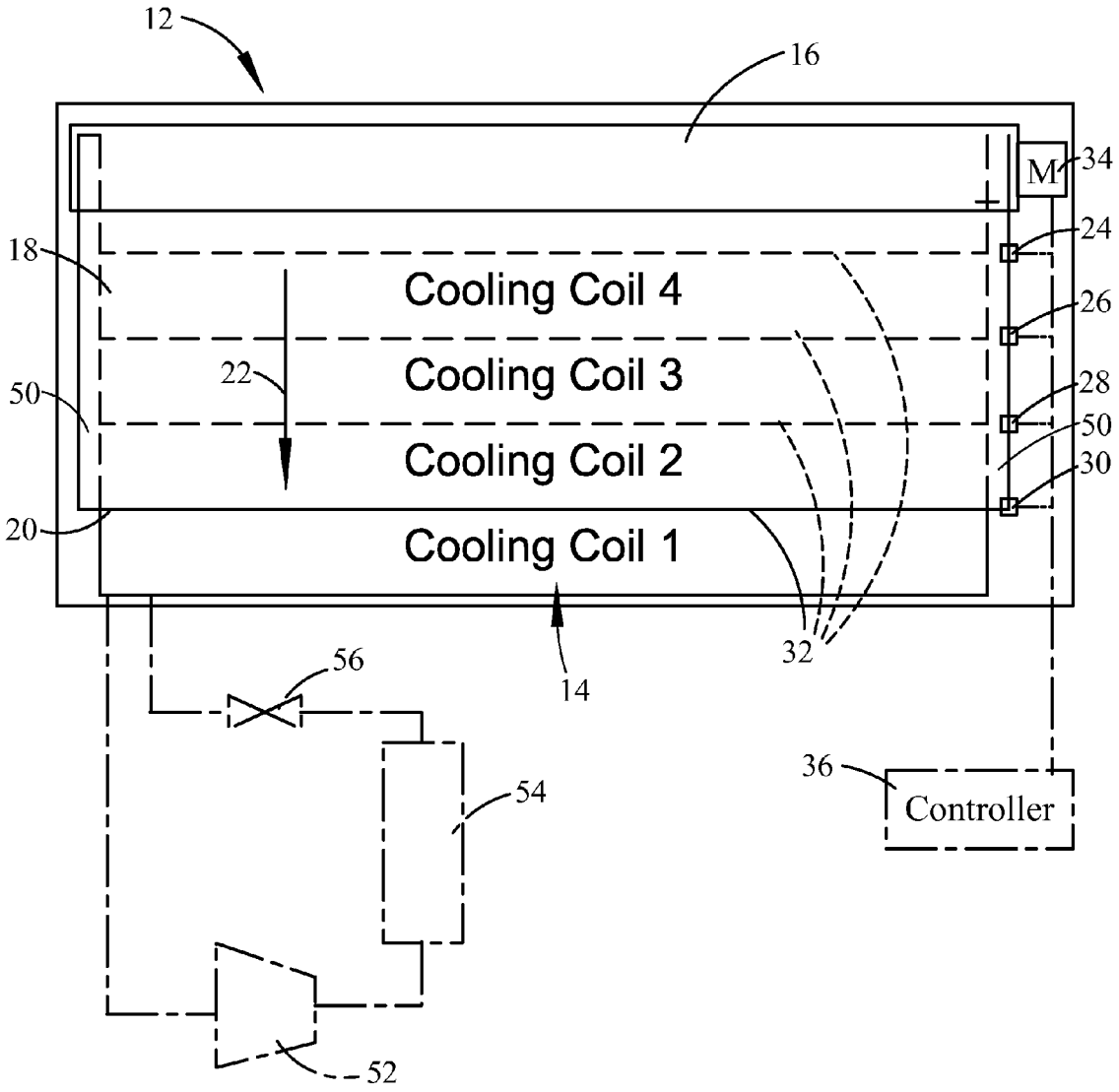

FIG. 1 is a side, elevation view of an air handler 12 with the closest side panel removed to show cooling coils 14 and an air curtain 18. FIG. 2 is vertical section view of the air handler taken along Section Line 2-2, looking toward an outward side of the air curtain 18. An air curtain housing 16 provides an enclosure into which the air curtain 18 is furled and from which the air curtain 18 is unfurled to move across one side of the cooling coils 14 and block air from passing through selected cooling coils 14. The cooling coils 14 are separated into separate sections 1-4 along a lineal direction 22. The air curtain 18 has first end and a terminal end 20 located on an opposite longitudinal end from the first end. Position sensors 24-30 are mounted in registration with edge regions 32 of the cooling coil sections 1-4 and detect when the terminal end 20 of the air curtain 18 is proximate to respective ones of the positions sensors 24-30. The cooling coil sections are configured such that they are sequentially aligned for extending along a lineal direction 22. A drive motor 34 furls and unfurls the air curtain 18 along the lineal direction 22 to selectively block airflow 46 through selected ones of the sections 1-4 of the cooling coils 14. A controller 36 operates the drive motor 34 to determine the position of the terminal end 20 of the air curtain with respect to the cooling coil sections 1-4 based on input from the position sensors 24-30 and whether individual ones of the cooling coil sections 1-4 are being used for conditioning the airflow 46 passing there-through. The cooling coil sections 1-4 are used when the compressors 52 for respective ones of the sections 1-4 are operating.

When the air curtain 18 is being removed from blocking one or more of the cooling coil sections 104 it is furled into a spiral-shaped roll 38, preferably around a roller 40. In other embodiments, the air curtain 18 may be furled on an inward edge of the air curtain 18 without use of a roller 40. The roller 40 may extend across the full width of the air curtain 18, but in some embodiments the roller 40 may be two or more separate bearings rotatably which are spaced apart for supporting the coiled roll 38 of the air curtain 18 adjacent to one end of the cooling coils 14. Two guide tracks 48 (one shown) are preferably located on opposite edges of the cooling coils 14. In some embodiments, a different number of the guide tracks 48 may be used.

The air curtain 18 has opposite side edge portions 50 which provide engaging portions or guide members for operatively coupling with the guide tracks 48 to guide movement of the terminal end 20 of the air curtain 18 in furling into and unfurling from the air curtain housing 16. The edge portions 50 of the air curtain 18 may be provided by wheels which are rotatably mounted and interfit with the guide tracks 48. In some embodiments the edge portions 50 may be protuberances which extend into and engage with the guide tracks 48, such as a pin or finger which slides within the guide tracks 48. In other embodiments the edge portions 50 may be peripheral edges of the air curtain 18.

The air curtain 18 may in some embodiments be provided by a conventional roll-up steel door such as those used for industrial applications for warehouses and the like. In other embodiments the air curtain 18 may be formed of materials other than steel, such as plastics, both pliable and rigid, and fabric.

Conventional air dampers 42 and a fan 44 with a drive motor is shown in FIG. 2. The fan 44 will draw the airflow 46 through the dampers 42, through the filters 58, and through the sections 1-4 of the cooling coils 14 which are not covered by the air curtain 18. The separate sections 1-4 of the cooling coils 14 are each preferably connected to a respective, different compressor 52 (one shown), condenser coil 54 (one shown), and expansion valve 56 (one shown).

The air curtain 18 is operated according to a sequence determined by the number of compressors 52 running which are connected to the air handler cooling coils 14. Preferably, the compressors 52 corresponding to the cooling coil sections 1-4 are operated to shut down and start such that the cooling coil sections 1-4 will be shut down from operating or start up along the lineal direction 22, corresponding to unfurling and furling the air curtain 18 for blocking air flow 46 through the ones of the cooling coil sections 1-4 which are not operating. If all four of the compressors 52 are running, the terminal end 20 of the air curtain 18 will be located adjacent the position sensor 24, with the air curtain fully raised to an uppermost position. This provides full airflow through the sections 1-4 of the cooling coils 14. If three of the compressors 18 are running, the terminal end 20 of the air curtain 18 will be located adjacent the position sensor 26. This provides for airflow through the cooling coil sections 1-3. If two of the compressors 18 are running, the terminal end 20 of the air curtain 18 will be located adjacent the position sensor 28. This provides for airflow through the cooling coil sections 1-2. If one of the compressors 18 are running, the terminal end 20 of the air curtain 18 will be located adjacent the position sensor 30. This provides for airflow through the cooling coil section 1 only. If heat is called for the terminal end 20 of the air curtain 18 is located at the position sensor 26, with the air curtain 18 fully raised. When in vent mode the air curtain 18 will preferably be left in the last position in which it was located.

The present invention provides advantages of an air curtain which will automatically prevent flow through cooling coils when not used for conditioning air passing through the air handler. The air curtain is rolled into a housing located to one side of the cooling cools and then unfurls for passing along one side of the cooling coils to block the flow of air passing through sections of the cooling coils not in use. When coolant flow through the unused sections of cooling coils begins the air curtain is furled back aside of the cooling coils, allowing airflow to again pass through the respective cooling coil sections.

Although the preferred embodiment has been described in detail, it should be understood that various changes, substitutions and alterations can be made therein without departing from the spirit and scope of the invention as defined by the appended claims.

What is claimed is:

1. An air handler comprising:

a plurality of cooling coils separated into separate sections along a lineal direction, said cooling coil sections defining edge regions proximate to adjacent ones of said cooling coil sections;

at least one guide member disposed adjacent to one side of said cooling coil sections, and extending at least in part along said lineal direction;

an air curtain disposed on said one side of said plurality of cooling coils and having a terminal end and at least on engaging portion, wherein said air curtain being flexible for furling and unfurling to selectively cover selected ones of said cooling coil sections at least generally along said lineal direction with said at least one engaging portion of said air curtain engaging said at least one guide member;

means for furling said air curtain to remove said air curtain from covering said selected ones of said cooling coil sections and for unfurling said air curtain for extending to cover said selected ones of said cooling coil sections;

at least one position sensor which is disposed proximate said air curtain and detecting when said air curtain is disposed for locating said terminal end of said air curtain proximate a selected one of said edge regions of respective ones of said cooling coil sections;

a drive motor connected to said means for furling and configured for rotating an end of said air curtain in a first angular direction for furling said air curtain, and rotating said end of said air curtain in a second angular direction for unfurling said air curtain and covering selected ones of said cooling coil sections along said lineal direction; and a controller for selectively locating said terminal end of said air curtain and operating said drive motor to furl and unfurl said air curtain for locating said terminal end of said air curtain to determine whether air flow is passed through respective ones said cooling coil sections disposed along said lineal direction.

2. The air handler according to claim 1, wherein said at least one guide member defines two opposed tracks disposed in opposed relation on opposite sides of lateral ends of said cooling coils, said two guide tracks extending parallel to said lineal direction.

3. The air handler according to claim 2, wherein said at least one engaging portion of said air curtain defines two oppositely disposed edge portions, wherein said edge portions engage respective ones of said two guide tracks for guiding said air curtain in moving along of said cooling coil sections.

4. The air handler according to claim 3, wherein said edge portions of said air curtain define guide members for fitting within said two guide tracks.

5. The air handler according to claim 4, wherein said guide members define wheels.

6. The air handler according to claim 1, wherein said cooling coil sections are connected to respective compressors and expansion valves.

7. The air handler according to claim 1, further comprising an air curtain housing for enclosing said air curtain when fully furled.

8. The air handler according to claim 1, wherein at least one position sensor comprises a plurality of position sensors, and said position sensors located in registration with said edge regions of said cooling coil sections.

9. The air handler according to claim 1 wherein said air curtain is formed steel sheets, such as that provided for roll-up doors.

10. An air handler comprising:

a plurality of cooling coils separated into separate sections along a lineal direction, said cooling coil sections defining edge regions proximate to adjacent ones of said cooling coil sections;

two guide tracks disposed in opposed relation on opposite sides of lateral ends of said cooling coils, said two guide tracks extending parallel to said lineal direction;

an air curtain disposed on one side of said plurality of cooling coils, said air curtain having two opposite edge portions and a terminal end, with said air curtain being flexible for furling and extending to selectively cover selected ones of said cooling coil sections along said lineal direction with said edge portions engaging respective ones of said two guide tracks;

position sensors disposed proximate said two guide tracks along said lineal direction, and detecting when a terminal end of said air curtain is proximate to respective ones of said position sensors;

a drive motor connected to said air curtain and configured for rotating a first end of said air curtain in a first angular direction for furling said air curtain into a coil, and rotating said first end of said air curtain in a second angular direction for unfurling said air curtain from said roller and covering selected ones of said cooling coil sections along said lineal direction; and a controller for selectively determining a position for locating said terminal end of said air curtain and operating said drive motor to furl inward or spool outward said air curtain from said roller for determining whether air flow is passed through respective ones said cooling coil sections disposed along said lineal direction.

11. The air handler according to claim 10, wherein said cooling coil sections are connected to respective compressors and expansion valves.

12. The air handler according to claim 10, further comprising an air curtain housing enclosing a roller and said air curtain which furled onto said roller.

13. The air handler according to claim 10, wherein said position sensors are located in registration with said edge regions of said cooling coil sections.

14. The air handler according to claim 10 wherein said air curtain is formed steel sheets, such as that provided for roll-up doors.

15. The air handler according to claim 10, wherein said edge portions of said air curtain define guide members for fitting within said two guide tracks.

16. The air handler according to claim 15, wherein said guide members define wheels.

17. An air handler comprising:

a plurality of cooling coils separated into separate sections along a lineal direction, said cooling coil sections defining edge regions proximate to adjacent ones of said cooling coil sections, wherein said separate sections are connected to respective compressors and expansion valves;

two guide tracks disposed in opposed relation on opposite sides of lateral ends of said cooling coils, said two guide tracks extending parallel to said lineal direction;

an air curtain disposed on one side of said plurality of cooling coils, said air curtain having two opposite edge portions and a terminal end, with said air curtain being flexible for furling and extending to selectively cover selected ones of said cooling coil sections along said lineal direction with said edge portions engaging respective ones of said two guide tracks;

an air curtain housing having a roller for furling said air curtain on said roller and enclosing said air curtain within said air curtain housing;

positions sensors disposed proximate said two guide tracks along said lineal direction, with said positions sensors located in registration with said edge regions of said cooling coil sections and detecting when a terminal end of said air curtain is proximate to respective ones of said positions sensors;

a drive motor connected to said roller and configured for rotating said roller in a first angular direction for furling said air curtain onto said roller and into said air curtain housing, and rotating said roller in a second angular direction for unfurling said air curtain out of said air curtain housing and covering selected ones of said cooling coil sections along said lineal direction; and a controller for selectively locating said terminal end of said air curtain and operating said drive motor to furl or unfurl said air curtain from said roller and said air curtain housing for determining whether air flow is passed through respective ones said cooling coil sections disposed along said lineal direction.

18. The air handler according to claim 17, wherein said edge portions of said air curtain define guide members for fitting within said two guide tracks.

19. The air handler according to claim 18, wherein said guide members define wheels.

20. The air handler according to claim 19, wherein said air curtain is formed steel sheets, such as that provided for roll-up doors.

* * * * *